United States Patent [19]

Lenz

[11] 4,136,602

[45] Jan. 30, 1979

[54] HYDRAULIC MOTOR

[76] Inventor: Leonard L. Lenz, 7400 Miami Lakes Dr., Miami Lakes, Fla. 33166

[21] Appl. No.: 689,668

[22] Filed: May 24, 1976

[51] Int. Cl.[2] ..... F01B 13/06

[52] U.S. Cl. ..... 91/491

[58] Field of Search ..... 91/491, 492, 499, 496, 91/498

[56] References Cited

U.S. PATENT DOCUMENTS

| | | | |
|---|---|---|---|
| 1,995,756 | 3/1935 | Smith | 91/496 |
| 2,101,829 | 12/1937 | Benedek | 91/498 |
| 2,703,054 | 3/1955 | Heater | 91/498 |
| 3,046,950 | 7/1962 | Smith | 91/491 |
| 3,122,971 | 3/1964 | Russell | 91/491 |
| 3,151,529 | 10/1964 | Leath | 91/491 |
| 3,274,898 | 9/1966 | Faisandier | 91/491 |
| 3,357,312 | 12/1967 | Rogou et al. | 91/491 |
| 3,403,599 | 10/1968 | Goinot | 91/491 |
| 3,587,401 | 6/1971 | Johansson | 91/496 |
| 3,587,402 | 6/1971 | Schluter | 91/498 |
| 3,661,057 | 5/1972 | Rogou | 91/498 |
| 3,796,136 | 3/1974 | Ogünl | 91/491 |
| 3,824,899 | 7/1974 | Dzioba | 91/491 |
| 3,913,455 | 10/1975 | Green | 91/492 |

FOREIGN PATENT DOCUMENTS

| | | | |
|---|---|---|---|
| 1019259 | 5/1954 | Fed. Rep. of Germany | 91/492 |
| 1322891 | 5/1969 | United Kingdom | 91/492 |
| 1255046 | 11/1971 | United Kingdom | 91/491 |
| 1261172 | 1/1972 | United Kingdom | 91/491 |
| 183076 | 9/1966 | U.S.S.R. | 91/492 |

*Primary Examiner*—William L. Freeh
*Attorney, Agent, or Firm*—Ronald E. Barry

[57] ABSTRACT

A hydraulic motor defined by a relatively compact structural design and capable of delivering high torque at low speeds. A drive shaft is mounted within a casing and disposed in surrounded relation to a cylinder housing which includes a predetermined number of equally spaced cylinders extending radially outwardly from the longitudinal axis of the shaft but being attached thereto. A piston is mounted for free floating movement within each of the cylinders and includes a cam rider attached thereto for disposable driving engagement with a cam surface. The cam surface is formed from a plurality of angularly oriented surface portions on a plurality of cam rings which are removably attached to the casing for replacement or substitution. An annular valve ring is disposed in surrounding relation to the shaft and in surrounded disposition relative to both the cylinder housing and a portion of the casing. Configuration and dimensioning of the valve ring is such as to floatingly engage the casing while allowing relative movement between the valve ring and the affixed cylinder housing and shaft. Fluid flow channels define the path of hydraulic fluid from an exterior source and exhaust facilities into the various cylinders by being formed either on the casing or the shaft so that either the casing or the shaft may serve as the rotating or fixed element thereby adding to the versatility of application of the motor.

21 Claims, 10 Drawing Figures

FIG. 1
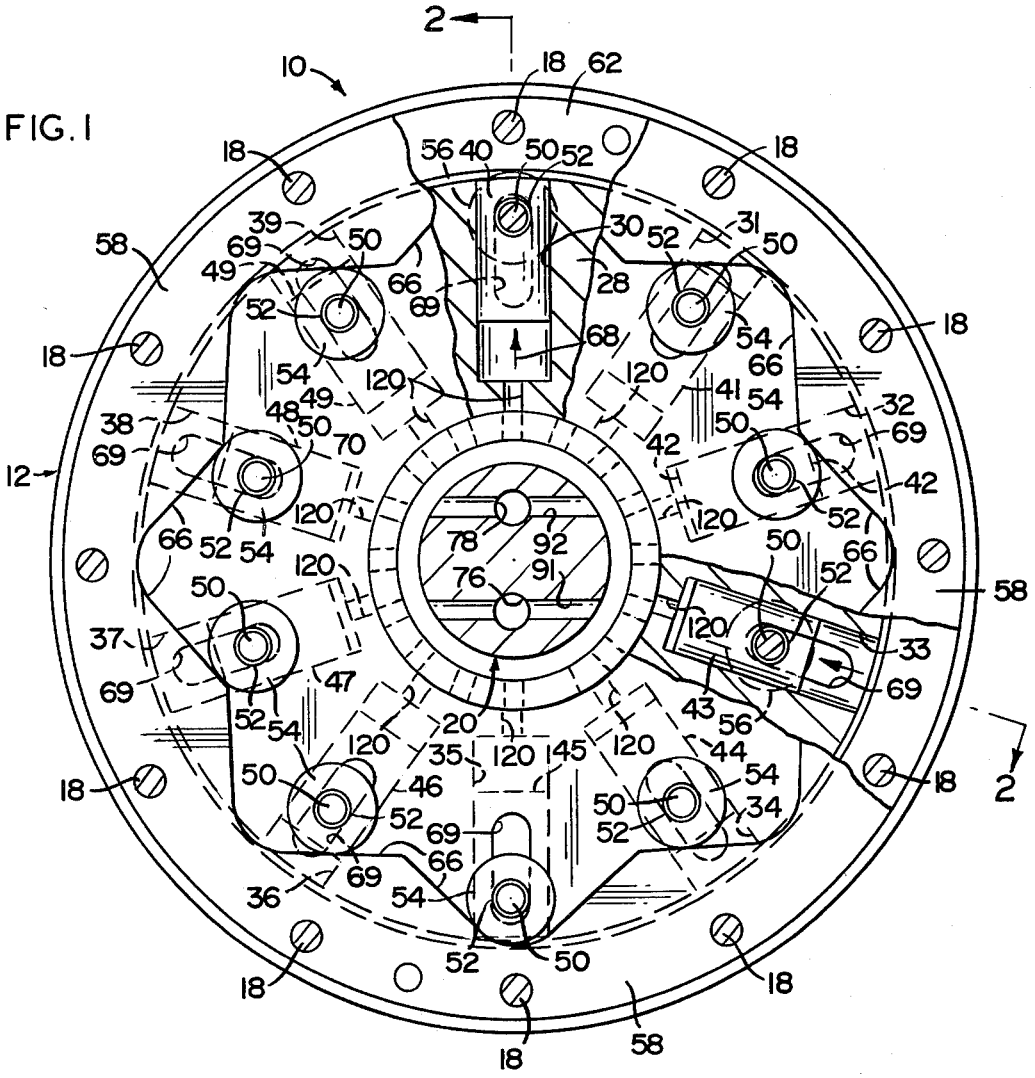
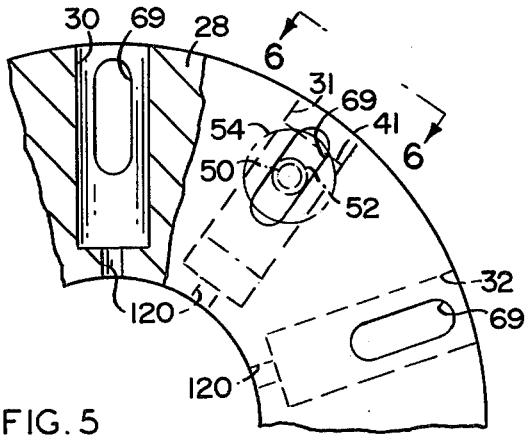
FIG. 5
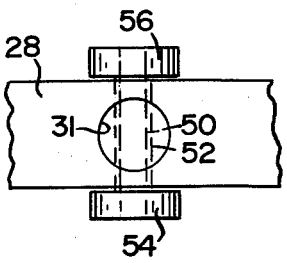
FIG. 6

FIG. 2
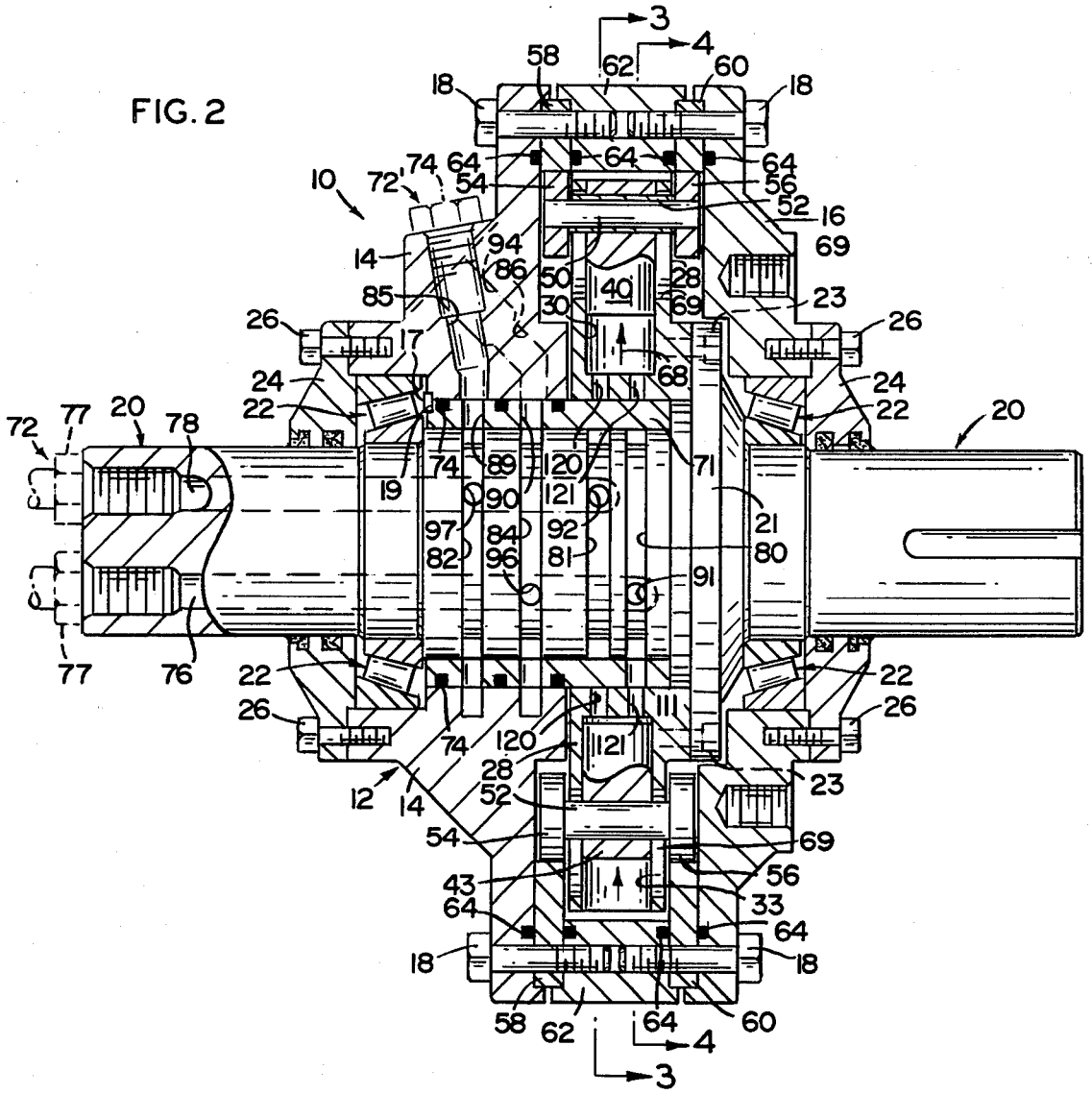
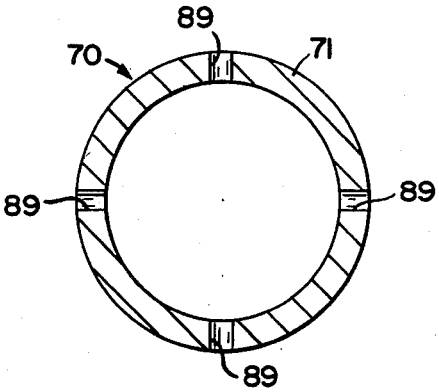
FIG. 8
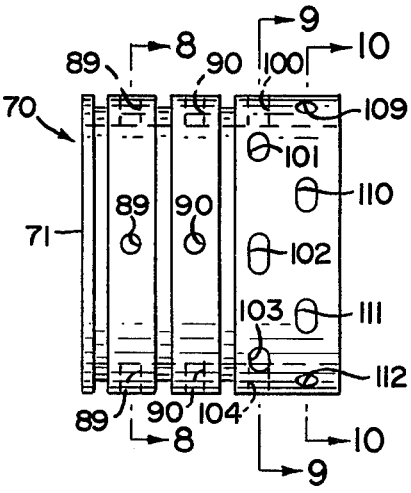
FIG. 7

FIG. 3
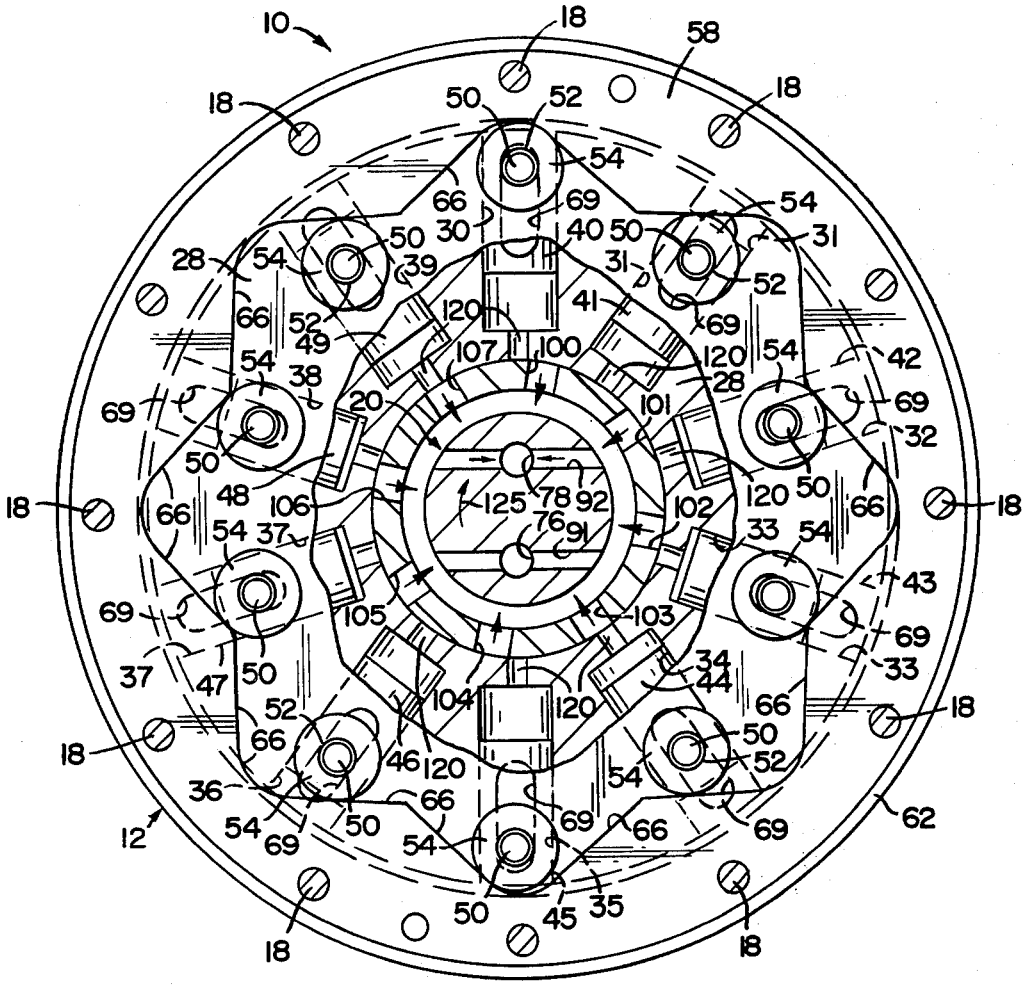
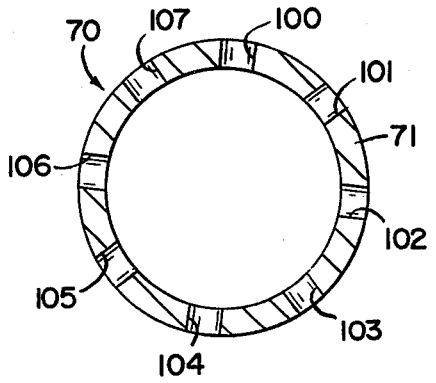
FIG. 9

FIG. 4
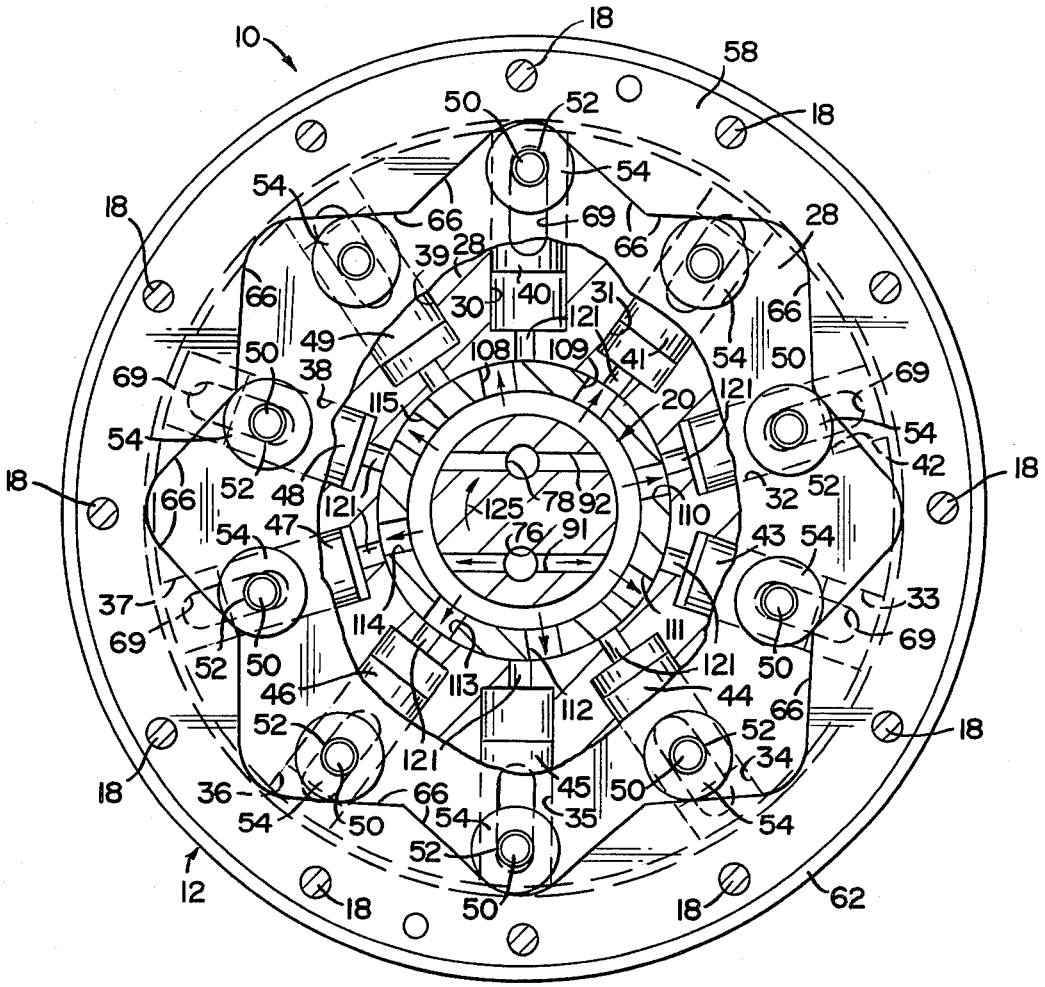
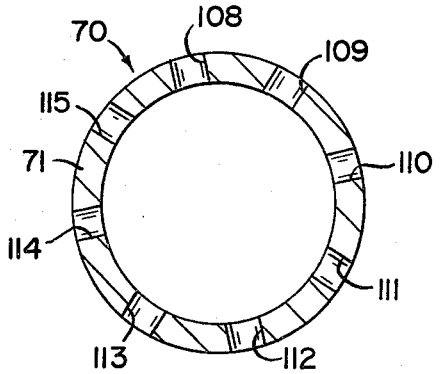
FIG. 10

HYDRAULIC MOTOR

BACKGROUND OF THE INVENTION

1. Field of the Invention

This invention relates to a hydraulic motor capable of producing high torque at relatively low speeds through a drive assembly including a plurality of fluid driven pistons forcing a cam rider mechanism into driving engagement with a cam surface of predetermined configuration which in turn regulates the speed and general operating characteristics of the motor.

2. Description of the Prior Art

Within the framework of a modern industrial society there is an ever increasing need for a motor design capable of operating under predetermined or desired operating characteristics. To answer a significant portion of such industrial needs the development and sophistication of the hydraulic motor has come into being. While the reliability and general applicability of hydraulic motors, to certain application is well recognized, it is similarly recognized that such prior art or conventional hydraulic motors have certain inherent structural problems which have a direct effect on the motor's operating efficiency or versatility for a variety of applications.

Commonly, a hydraulic motor is utilized where high torque output requirements are needed at low speeds of motor operation. However, accomplishing such efficient operating characteristics utilizing conventional motor design has generally been considered difficult and less than satisfactory with certain prior art hydraulic motors which are not commercially available.

Commonly, in order to accomplish low speed and high torque drives in the hundreds of applications where they are required it has been necessary to incorporate costly gear reducers, chain sprockets or similar type gearing linkage before coupling the prior art motors to the equipment to be driven. Such additional gear linkage obviously adds to the overall cost of both initial purchase and maintenance of a given operation. In addition, there is a recognized need for a hydraulic motor having sufficient versatility to deliver equal power when driven in either a forward or reverse direction, as well as having structure designed to accomplish dynamic braking and freewheeling of the structural components if desired. From an economic standpoint as well as adding to its versatility such a hydraulic motor should be compact and rather small in size and weight in relation to its power output. Such a preferred motor design should be capable of operating in relatively hazardous, explosive environment as well as in a completely submerged state as when operated under water.

SUMMARY OF THE INVENTION

This invention relates to a hydraulic motor primarily designed for low speed and high torque drive applications. The motor comprises a casing preferably having two casing portions interconnected to one another by substantially conventional threaded type connectors. The two casing portions are both disposed in substantially surrounding relation to a shaft means. The shaft means is mounted on the interior of the casing in such a manner that the shaft means and the casing are disposed in movable relation to one another.

A cylinder housing is disposed on the interior of the casing substantially between the two casing portions and is connected in fixed relation to the shaft means.

The cylinder housing comprises a plurality of cylinders formed therein where, in the preferred embodiment, ten cylinders are provided in equally spaced apart relation to one another and disposed in substantially outwardly extending radially oriented relation to the central axis of the shaft means.

The hydraulic motor of the present invention further includes a plurality of piston means each of which are mounted in one of the cylinders formed in the cylinder housing. Each of the piston means are specifically dimensioned and configured so as to be movably disposed within one of the cylinders in substantially free floating relation therein. The term "free floating" is meant to describe the movement and disposition of the piston within the cylinder wherein the piston body is not attached to any piston arm, crankshaft, etc. The disposition of the piston body within the cylinder is dependent upon the quantity and/or direction of flow of the fluid within the cylinder.

The specific flow of the hydraulic fluid to and from the various cylinders within the cylinder housing and the driving force of the hydraulic fluid upon the plurality of cylinders will be described in greater detail hereinafter with specific reference to the path of fluid flow of the entire motor.

The hydraulic motor of the present invention further comprises drive means including cam rider means attached to each of the plurality of piston bodies mounted within the various cylinders of the cylinder housing. In the preferred embodiment of the present invention the cam rider means includes two roller elements rotatably mounted on a common axis which in turn is attached to the piston body. The two roller elements are each mounted on opposite sides of the piston body in substantially aligned relation to one another. More particularly, the roller elements extend laterally outward from the piston and are located on the exterior of the individual cylinders in which the piston bodies are movably disposed. The drive means further comprises cam means preferably in the form of at least two cam elements each having an annular configuration and disposed in spaced apart relation to one another and on substantially opposite sides of the cylinder housing. Each of the annularly configured cam elements are disposed in substantially surrounding relation to the cylinder housing and are each removably attached to the two casing portions by substantially conventional threaded connectors as set forth above. Adequate, annularly configured spacer means serves to properly dispose each of the cam elements into predetermined relation for engagement with the two roller elements of each piston which define the cam rider means.

A cam surface is defined on the inner peripheral edge of each cam element and is defined by a plurality of surface portions disposed in angular relation to one another. Each angularly oriented surface portion is disposed at an angular inclination substantially opposite to the next adjacent angularly oriented surface portion. Accordingly, a plurality of high points and low points are alternately disposed in equally spaced relation to one another about the annularly configured, continuous cam surface. In the preferred embodiment of the present invention each of the oppositely inclined angularly oriented surface portions are disposed at substantially a 45° angle relative to a reference tangent of a circle defined by either the high points or low points along the continuously disposed cam surface.

As will be explained in greater detail hereinafter the driving force exerted on the piston by the hydraulic fluid causes movable engagement between the roller elements comprising the cam means and the cam surface itself. By virtue of this disposition the particular speed of rotation of the motor is at least in part determined by the degree of angular inclination of the various angularly oriented surface portions. As set forth above, while an inclination of 45° is preferable, each of the cam elements may be readily replaced due to their removable connection to the casing portions so as to vary the speed and the resulting torque produced by the motor, dependent upon the particular application for which the motor is intended.

Further structural features of the present invention comprise the provision of a valve means having a substantially annular configuration and disposed on the interior of the casing in surrounding relation to a predetermined portion of the shaft means. In addition, the disposition of the valve means is such as to be surrounded by a substantially adjacent portion of the cylinder housing and one of the casing portions. The dimensions and configuration of the valve ring is such as not to be specifically affixed to the casing portion but rather be maintained in floating relation thereto through the maintenance of a specific spacing within predetermined tolerances between the outer surface portion of the valve ring and the correspondingly positioned inner surface of the casing portion surrounding the valve ring.

More particularly, seal means in the form of a plurality of O rings are disposed in spaced relation to one another on the external surface of the valve ring. This disposition of the plurality of seal rings establishes a sealing engagement between the external surface of the valve ring and the internal surface of the casing portion. However, a "free floating" engagement exists between these two portions. This floating engagement is provided through the maintenance of a spacing tolerance between these two surfaces of approximately 0.005 inches. This free floating relationship thereby prevents seizure or binding of the valve ring onto the casing portion or alternately onto the correspondingly disposed exterior surface of the shaft means when relative rotation occurs between either the casing portion and the valve means or alternatively the shaft means and the valve means as again will be explained in greater detail hereinafter.

The disposition of the valve ring is such as to regulate fluid flow to the various pluralities of cylinders from the flow channel means formed on the shaft means.

More particularly, the hydraulic motor comprises access ports which are disposed in fluid communication with both supply and exhaust facilities. These facilities are per se not a part of the present invention but may be conventional means of directing hydraulic fluid to and from the access port of the motor.

In one embodiment of the present invention the access port means are formed directly on one extremity of the shaft means and communicate with flow channel means comprising at least two flow channels defined in part on the interior of the shaft means and in part on the exterior of the shaft means. The exterior portion of the flow channel is disposed in direct fluid communication with the valve means which in turn is disposed in fluid regulating position between the hydraulic fluid issuing from the shaft means and the entrance of this fluid into the plurality of cylinders.

Alternately another embodiment of the present invention comprises the access port means being formed on one of the casing portions and disposed in intercommunicating relation to the flow channel means of the shaft means through interconnecting conduits.

The provision of the access ports either on the shaft means or on the casing means allows either the shaft means or the casing to serve as either the driven member or the driving member. More specifically, defining of the path of fluid flow in this manner allows application of the hydraulic motor wherein the shaft means is rotatably driven relative to a fixed position of the casing. Alternatively, pumping of fluid to and from the shaft means into the various cylinders allows the static position of the shaft means and the rotational movement of the casing relative to the shaft means.

The valve ring comprises two sets of valve ports, each set being arranged in a substantially annular configuration and comprising eight ports equally spaced from one another. In addition, the valve ports of each set are equally spaced from each other linearly and offset from one another laterally so as to alternately come into direct fluid communication with alternate ones of two cylinder ports formed in the base of the cylinder. These cylinder ports comprise a first and second cylinder port defined in each cylinder wherein either of the first or second cylinder ports may comprise either an inlet or an outlet port relative to hydraulic fluid passing into and out of the individual cylinders.

When each pair of opposed pistons and rollers have reached the low point on the cam surface, one of the cylinder ports in each cylinder is closed and the opposite cylinder serves as a return port. This return port is open and allows the piston to expel the fluid previously forced into the cylinder, through the return channel which defines the flow channel means and the shaft means. As the cylinder passes a high point on the cam surface, one of the cylinder ports acting as the inlet port opens and pressurized fluid is allowed to flow therein, resulting in the power stroke. Therefore, four pistons mounted in the cylinder housing are pressurized or moving in their power stroke at any position of the rotation. In that the preferred embodiment defines the cam surface on each of the cam ring elements to have eight high points, eight power strokes for each complete revolution is accomplished. Through the utilization of ten pistons in the cylinders of the cylinder housing, each piston cycles eight times per revolution to create a total of 80 power strokes per complete revolution of the cylinder housing.

It should be emphasized that rotating forces being exerted on the cam surface by the rollers of the cam rider means at a point farthest from the central axis of the shaft means creates the maximum possible leverage due to the fact that the effective lever arm is constantly increasing as the rollers and pistons under pressure travels from a high point on the cam surface to a low point, disposed farthest from the central axis of the shaft means.

An important structural feature of the present invention is directed to the specific disposition and structure of the various cylinders, piston bodies within the cylinders and structural design of these piston bodies. More specifically, the hydraulic motor of the present invention may be compactly structured while still developing high torque drive. In each cycle four pistons are in their power stroke. Each of these four are always disposed in diametrically opposed relation to one another relative to the central axis of the shaft means. Also each of the four are adjacently positioned relative to one other of these four. Therefore, the motor is always in complete balance and there is no unnecessary load placed on the shaft means. Also since the pistons are free floating the driving force exerted by the piston is exerted in a colinear relation along the central axis of the piston body and the direction of travel thereof. This single throw, in-line balanced relationship allows for a compact structure and design of smaller dimension for the overall structure.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a sectional view in partial cutaway showing the relative disposition and internal working of the pistons, cylinders, cylinder housing and drive assembly of the present invention.

FIG. 2 is a sectional internal view taken along line 2—2, in partial cutaway, showing the interior of the casing.

FIG. 3 is a sectional view along line 3—3 of FIG. 2 showing the relative locations of the pistons and the exhaust valve port during a complete cycle of the cylinder housing.

FIG. 4 is a sectional view, in partial cutaway, along line 4—4 showing the embodiment of FIGS. 2 and 3 relative to the disposition of the valve ring and the set of valve ports defining the inflow of pressurized hydraulic fluid.

FIG. 5 is a partial cutaway view in section showing details of the cylinder and piston means assembly.

FIG. 6 is a top view taken along line 6—6 of FIG. 5.

FIG. 7 is a detail view of the exterior of the valve means of the present invention.

FIG. 8 is a sectional view along line 8—8 of FIG. 7.

FIGS. 9 and 10 are sectional views along lines 9—9 and 10—10, respectively, of FIG. 7 showing details of the two valve port sets.

Similar reference characters refer to similar parts throughout the several views of the drawings.

DETAILED DESCRIPTION

As best shown in FIGS. 1 and 2 the hydraulic motor of the present invention is generally indicated as 10 and comprises a casing 12 including two casing portions 14 and 16 interconnected to one another about correspondingly positioned peripheral portions by substantially standard or conventional threaded connectors 18. A shaft means generally indicated as 20 is mounted on the interior of the casing in substantially surrounded relation by the two casing portions 14 and 16. Bearing means 22 are disposed about substantially opposite or spaced apart portions of the shaft means 20 and serve to effect rotation between the shaft means 20 and the casing 12. End cap portions 24 are interconnected to the various casing portions 14 and 16 by connectors 26 and serve to enclose the bearing means 22 and maintain the bearing means in the proper supporting relation relative to the shaft means 20 and the casing 12.

A cylinder housing 28 is disposed on the interior of casing means 12 and more particularly in enclosed relation between the two casing portions 14 and 16 and in substantially surrounding relation to the shaft means 20. With reference to FIGS. 1, 3 and 4, the cylinder housing 28 comprises a plurality of cylinders 30–39 disposed in equally, spaced apart relation to one another and extending radially outward from the central axis of the shaft means 20.

In the preferred embodiment ten cylinders are formed in the cylinder housing 28 and a piston means is movably disposed in each of these cylinders. More specifically, individual piston bodies 40–49 are dimensioned and configured to be free floating within the cylinders 30–39, respectively, as shown in FIGS. 1, 3 and 4. As best shown in FIGS. 2, 3, 4 and 6, each of the pistons comprise a cam rider means attached thereto.

More particularly, the hydraulic motor of the present invention comprises a drive assembly which includes a cam rider means. With specific reference to FIG. 2 the cam rider means includes an access shaft 50 mounted within bushing member 52 and having roller elements 54 and 56 rotatably mounted on opposite ends of each shaft 50. These roller elements serve as cam riders to engage cam means including, in the preferred embodiment, a pair of cam rings 58 and 60. Each of these cam ring elements 58 and 60 are removably mounted to the casing 12 and more particularly the individual casing portions 14 and 16. This removable connection takes place also by means of the conventional threaded connectors 18 as set forth above. An annularly configured spacer member 62 (FIG. 2) is disposed between the cam ring elements 58 and 60 so as to maintain them in proper, spaced apart relation and disposed adjacent opposite exterior portions of the cylinder housing 28. A plurality of seal elements 64 are utilized to establish sealing engagement between the casing portions 14 and 16 and the spacer 62 and the individual cam rings 58 and 60.

Accordingly, the roller elements 54 and 56 are disposed in continuous movable engagement with each of the cam ring elements 58 and 60. More particularly, and as will be explained in greater detail hereinafter, the individual elements 54 and 56 are disposed in driving, continuous engagement with the continuously disposed and annularly configured cam surface 66 disposed or defined on the interior peripheral edge of each of the cam ring elements 58 and 60. Movement of the individual pistons 40–49 in their individual cylinders 30–39 is caused by the pressure exerted by the hydraulic fluid as indicated by directional arrow 68 (FIGS. 1 and 2). The exerted pressure causes a continuous outward movement of the individual pistons so that the roller elements 54 and 56 engage the continuous cam surface 66. The movement of the rollers 54 and 56 with the piston is accomplished by the structure which is best shown in FIG. 5. In each of the cylinders an elongated slot means 69 is provided so as to accommodate the shaft 50 and more particularly the bushing sleeve 52 in which it is mounted. Accordingly, the individual cylinders and specifically the oblong or elongated group 69 serve as guides to direct these laterally spaced apart and externally positioned rollers 54 and 56 into engagement with the cam surfaces of the individual cam rings 58 and 60. The provision of two such rollers 54 and 56 in spaced apart relation to one another on opposite sides of the individual pistons prevents a cantilever type action from occurring since the force of the piston acting against the cam surface through the individual roller elements 54 and 56 is evenly distributed on both sides thereof. More specifically, the force of the individual pistons is exerted in an evenly balanced and distributed fashion since the axis shaft 50 is mounted directly to the piston head and to extend outwardly therefrom on both sides thereof. The force exerted by the piston, through the two rollers is therefore applied along the direction of travel of the piston, evenly, from both sides thereof.

With reference primarily to FIGS. 2 and 7, the hydraulic motor of the present invention comprises a valve means generally indicated as 70 and including an annularly configured valve ring 71 disposed in immediate surrounding relation to a predetermined portion of the shaft means 20 and in a substantially surrounded relation relative to the cylinder housing 28 and the casing portion 14 as best shown in FIG. 2. The valve ring 71 is specifically designed and configured to allow some movement between itself and the housing portion 14 and thereby maintains a substantially "free floating" relationship therewith. The dimensions of the valve ring 71 is such that the valve ring moves essentially with the housing portion 14 it is not fixedly attached thereto. However, a key element 17 is affixed to casing portion 14 and a correspondingly disposed and configured key way 19 is formed in the valve ring. Therefore, while slight movement is allowed between the ring element 71 and the casing portion 14, the key and key way assembly force rotational movement of the valve ring 71 with the casing portion 14. The valve ring 71 is rotationally movable relative to the shaft means 20. A slight spacing is maintained between the exterior surface of the valve ring 71 and the correspondingly positioned interior surface of the casing portion 14. This spacing is maintained within predetermined tolerances and generally in the range of 0.005 to 0.007 inches. In addition, sealing means in the form of a plurality of sealing elements 74 establishes a sealing engagement between the valve ring 71 and the correspondingly positioned interior annular surface of the casing portion 14. In any event this close tolerance and "free floating" relation between the ring 71 and the casing portion 14 prevents seizure or binding of the ring during operation of the motor and relative movement between the shaft means 20 and the casing portion 14 and the valve ring itself 71.

With regard to FIGS. 2, 7 and 8 the motor of the present invention comprises access ports generally indicated as 72 formed in the substantial end portion of the shaft means 20. Alternately, access port 72' may be formed in the casing portion 14. The provision of two access ports is to allow relative movement of either the shaft means 20 or the casing 12 as the "rotor" of the motor while in turn, either the shaft means 20 or the casing 12 may serve as the fixed stator while the opposite member rotates. Therefore, while hydraulic fluid enters and exits through access port 72 of shaft means 20, the access port 72' are plugged by stop means 74 represented in broken lines in FIG. 2. In this embodiment the casing would serve to rotate about the fixed, central axis of the shaft means 20 and the stop means 74 would be positioned in place so as to allow fluid flow through the interior of the shaft means 20 through channels 76 and 78 to and from the valve ring 71 and the individual cylinders as will be explained in greater detail hereinafter. On the other hand, stop means 77 may be applied through the access port 72 and the shaft means 20 thereby directing hydraulic fluid to and from the motor through the access port 72'. In this embodiment the shaft means and attached cylinder housing 28 would serve as the rotor while the casing 12 would remain stationary and allow movement of the shaft means 20 and the cylinder housing 28 relative thereto.

With reference to FIG. 2 the flow channel means formed in the shaft means 20 further includes the channel 76 and 78 comprising the interior portion of the flow channel while the annularly configured grooves 80 and 81 are formed on the exterior portion of the shaft means 20. An auxiliary set of annularly configured grooves 82 and 84 are also disposed on the exterior portion of the shaft 20 so as to accommodate fluid passing to and from the cylinders by means of access port 72'. In this latter embodiment interconnecting conduits 85 and 86 serve to supply fluid into and from the grooves 82 and 84, respectively, through the first plurality of apertures 89 and the second plurality of apertures 90.

Therefore, again with reference to FIG. 2 fluid passing through inlet channel 76 from access port 72 flows to cross conduit 91 and enters annular groove 81 for direct communication with the valve ring 71. Similarly, fluid exiting from the individual cylinders passes from the valve ring 71 (to be explained in greater detail hereinafter) into the annular groove 81 and into cross conduit 92 (FIG. 3) into outlet channel 78. The fluid is then exited through the access port 72. When the stop means 77 are applied to the access port 72, the fluid is supplied to an exhaust from the motor through access port 72'. In this embodiment interconnecting conduit shown in broken lines in FIG. 2 and represented as 94 serves to connect the access port 72' with the annular groove 84 through the second plurality of apertures 90 in the valve ring 72. The fluid flows in through cross conduit 96, into inlet channel 76 and out through cross conduit 91 into annular groove 81 for direct communication with the valve ring 71. Similarly, exhausting of the hydraulic fluid after leaving the cylinders takes place through annular groove 80, cross conduit 92, outlet channel 78, cross conduit 97, plurality of apertures 89, in the valve ring 72 and finally through the interconnecting conduit 85 which has direct access to the access port 72'.

With reference to FIGS. 3, 4, 9 and 10 the flow of fluid to and from the various cylinders will be represented for the power stroke and exhaust stroke of the various cylinders represented in full cycle.

FIG. 9 is a sectional view through the embodiment of FIG. 7 along line 9—9 and represents a first set of valve ports of which, in the preferred embodiment, there are eight in number. These individual valve ports are represented as 100–107. Similarly, FIG. 10 is a sectional view through FIG. 7 representing the second set of valve ports 108–115. With corresponding reference to FIGS. 3 and 4 path of fluid flow from and to the various cylinders and their interaction on the various pistons is shown. First with reference to FIG. 4 and accompanying FIG. 10, fluid passing through either of the access ports 72 or 72' will enter through inlet channel 76 and cross channel 91 into the annular groove 81. From this point the hydraulic fluid will pass through any open cylinder inlet port formed in the base of the cylinders. Two such cylinder ports are provided in the base of each cylinder and are indicated in FIG. 2 as 120 and 121. At this point it should be made clear that either of the ports may act as an inlet or an outlet port depending upon the direction of rotation of the motor. Also, since the cylinder housing 28 is fixedly attached to the annular flange 21 by connectors 23 there is a relative rotational movement between the valve ring 71 and the various cylinders and more particularly the cylinder ports 120 and 121. Accordingly, these cylinder ports are constantly being brought into alignment and fluid communication with the various sets of valve ports 100–107 (communicating with cylinder port 120) and valve ports 108–115 (communicating with cylinder port 121).

For purposes of explanation it will be assumed that the shaft means 20 and accordingly the cylinder housing 28 is rotating in the direction indicated by directional arrow 125 in FIGS. 3 and 4. Therefore, fluid passing through elongated channel 76, cross conduit 91 and into annular groove 81 pass into the various opened or exposed valve ports which are then aligned in communication with one of the cylinder ports 121 of each of the cylinders. With the representation of FIG. 4 it can be made clear that valve ports 109, 110, 113 and 114 are aligned with the respectively positioned cylinders 31, 32, 36 and 37. Accordingly, the pistons in these respective cylinders are under pressure and are in their power stroke. The remaining cylinders are either directly exposed to the exhaust valve ports 100–107 or are sealed off.

With reference to FIG. 3 it can be seen that cylinders 33, 34, 38 and 39 are exposed to exhaust whereby the pistons therein are in their exhaust stroke and fluid in these cylinders is being exited through various valve ports just mentioned, annular groove 81, cross conduit 92 and out through channel 78 in the shaft means 20.

Therefore, it is clear that the hydraulic motor of the present invention comprises at least four diametrically opposed pistons in the pressure stroke mode at all times thereby delivering torque to the takeoff of the motor.

Reversing of the motor can be readily accomplished merely by reversing the direction of fluid flow. Operation of the motor will be precisely the same with the direction of rotation being reversed.

It will thus be seen that the objects made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all the generic and specific features of the invention herein described, and all statements of the scope of the invention, which, as a matter of language, might be said to fall therebetween.

Now that the invention has been described,

I claim:

1. A hydraulic motor of the type designed to deliver high torque at relatively low speed, said hydraulic motor comprising:

a casing, a shaft having fluid inlet and outlet passages mounted within said casing in movable relation to said casing, a cylinder housing fixed to said shaft and disposed in substantially surrounding relation to said shaft, said cylinder housing including a plurality of cylinders formed therein in spaced relation to one another and in radially, outwardly extending relation to the central axis of said shaft, valve means mounted on said shaft in floating relation to said shaft and said cylinder housing, said valve means being connected to said casing and disposed in fluid regulating disposition between said fluid inlet and outlet passages in said shaft and said plurality of cylinders;

a piston movably disposed in each of said plurality of cylinders;

each piston being dimensioned and configured relative to the corresponding cylinder so as to be movable in floating relation to the interior of the respective cylinder;

cam means mounted in said casing and disposed in substantially outwardly surrounding relation to said cylinder housing, said cam means comprising a cam element having a continuous cam surface defined by a plurality of surface portions disposed in angular orientation to one another, said adjacently positioned of said angularly oriented surface portions being disposed in oppositely inclined relation to one another thereby defining alternately disposed high and low points on said cam surface, the relative orientation of said cam surface portions being configured to determine the operable speed of said hydraulic motor whereby different operating characteristics of said motor may be accomplished by substituting cam means therein which include surface portions of different angular configurations, cam follower means connected to each of said pistons and disposed in movable driving engagement with said cam surface portions, whereby fluid passing through said valve means into said predetermined plurality of cylinders causes outward movement of said pistons relative to said shaft, said cam follower means moving into driving engagement with said cam means to cause rotation of one of said casing and shaft;

each of said pistons being disposed in diametrically opposed coaxial relation to one other of said pistons relative to the central axis of said shaft, said cam surface portions being configured to concurrently orient each of said opposed pistons in the same cycle phase through movable engagement of said cam follower means with said cam surface portions, said valve means providing fluid communication to at least two adjacent pairs of diametrically opposed pistons at substantially all times, whereby said shaft is subjected only to equal and opposed forces by said diametrically opposed pistons and continuous turning force during their operation and movement within said respective ones of said plurality of cylinders.

2. The hydraulic motor as in claim 1 wherein said plurality of cylinders comprises ten such cylinders, said pistons being movable in free floating relation to each of said cylinders; said cylinders being disposed in radially surrounding relation to said valve means, wherein said two adjacently disposed pistons on opposite sides of said shaft are under fluid pressure and define power strokes, whereby said motor is in balance relative to the drive forces applied to said drive means during operation of said motor.

3. The hydraulic motor as in claim 1 wherein said valve means comprises a cylindrical member disposed between said shaft and said casing and between said shaft and said cylinder housing; seal means disposed in sealing engagement between said casing and said valve means and said valve means being dimensioned and configured for spaced disposition within predetermined tolerances from said casing, said valve means being connected to said casing and disposed for relative movement with respect to said shaft.

4. The hydraulic motor as in claim 1 further including access port means comprising inlet port means and outlet port means disposed in fluid communication with a fluid source and with exhaust facilities, said access port means disposed on said shaft means in direct fluid communication with said fluid passages.

5. The hydraulic motor as in claim 1 further including access port means comprising an inlet port means and an outlet port means disposed in fluid communication with a fluid source and an exhaust facility, said access port means being formed in said casing and disposed in fluid communication with said fluid passages by interconnecting conduit means.

6. The hydraulic motor as in claim 1 wherein said cam follower means is connected laterally to each of said pistons and disposed in laterally outwardly extending relation to said cylinder housing in which said respective pistons are mounted, said pistons and attached cam follower means being disposed for outward movement from said shaft into driving engagement with said cam means upon fluid entrance into said respective cylinders.

7. The hydraulic motor as in claim 6 wherein said cam means comprises at least two cam elements having a substantially annular configuration, said cam elements located in spaced apart relation to one another and disposed on substantially opposite sides of said cylinder housing, said cam follower means extending laterally outward from opposed sides of said respective pistons and said cylinder housing in which said pistons are mounted, said cam follower means being positioned in movable engagement with said cam elements.

8. The hydraulic motor as in claim 7 wherein said cam follower means comprises oppositely disposed roller elements movably connected to each of said pistons in axially aligned relation to one another and mounted on the exterior of the cylinder housing and in movable engagement with the respective cam element.

9. The hydraulic motor as in claim 1 wherein each of said plurality of cylinders includes a first and second cylinder port formed in a base wall of each of said cylinders and disposed in fluid communication with said valve means, whereby fluid enters and exits each of said cylinders dependent upon the relative disposition between each of said cylinders and said valve means.

10. The hydraulic motor as in claim 9 wherein said valve means includes a cylindrical member disposed in surrounding relation to said shaft and disposed in surrounded disposition relative to said cylinder housing, said valve means including a first set of valve ports disposed in linearly spaced relation to one another and located in fluid communication with said first cylinder port of each cylinder in said cylinder housing, a second set of valve ports disposed in linearly spaced relation to one another and located in fluid communication with said second cylinder port of each cylinder in said cylinder housing.

11. A hydraulic motor as in claim 10 wherein both said first set of valve ports and said second set of valve ports comprise an equal, predetermined number of valve ports, said first set of valve ports being laterally spaced and linearly offset from correspondingly positioned of said second set of valve ports.

12. A hydraulic motor of the type designed to deliver high torque at relatively low speed, said hydraulic motor comprising:

a casing including at least two casing portions removably interconnected to one another, a shaft having fluid inlet and outlet passages mounted within said casing in movable relation to said casing, each of said casing portions being disposed in substantially surrounding relation to said shaft, a cylinder housing fixed to said shaft and disposed in substantially surrounding relation to said shaft, said cylinder housing including a plurality of cylinders formed therein in spaced relation to one another and in radially, outwardly extending relation to the central axis of said shaft, valve means mounted on said shaft in floating relation to said shaft and said cylinder housing, said valve means being connected to said casing and disposed in fluid regulating disposition between said fluid inlet and outlet passages in said shaft and said plurality of cylinders, a piston movably disposed in each of said plurality of cylinders, each piston being dimensioned and configured relative to the corresponding cylinder so as to be movable in floating relation to the interior of the respective cylinder;

cam means disposed between and in substantially enclosed relation to said casing portions and disposed in substantially outwardly surrounding relation to said cylinder housing, said cam means being removably attached to said two casing portions, cam follower means connected to each of said pistons and disposed in movable driving engagement with said cam means, whereby fluid passing through said valve means into said predetermined plurality of cylinders causes outward movement of said pistons relative to said shaft, said cam follower means moving into driving engagement with said cam means to cause rotation of one of said casing and shaft, each of said pistons being disposed in diametrically opposed coaxial relation to one other of said pistons relative to the central axis of said shaft, whereby said shaft is subjected only to equal and opposed forces by said diametrically opposed pistons and continuous turning force during their operation and movement within said respective ones of said of plurality of cylinders and the operating characteristics of said motor can be changed by substituting cam means therein which includes surface portions of different angular configurations.

13. The hydraulic motor as in claim 12 wherein said cam follower means is connected laterally to each of said pistons and disposed in laterally outwardly extending relation to said cylinder housing in which said respective pistons are mounted, said pistons and attached cam follower means being disposed for outward movement from said shaft into driving engagement with said cam means.

14. The hydraulic motor as in claim 12 werein said valve means comprises a cylindrical member disposed between said shaft and said casing and between said shaft and said cylinder housing; seal means disposed in sealing engagement between said casing and said valve means and said valve means being dimensioned and configured for spaced disposition within predetermined tolerances from said casing, said valve means being connected to said casing and disposed for relative movement with respect to said shaft.

15. The hydraulic motor as in claim 12 further including access port means comprising inlet port means and outlet port means disposed in fluid communication with a fluid source and with exhaust facilities, said access port means disposed on said shaft means in direct fluid communication with said fluid passages.

16. The hydraulic motor as in claim 12 further including access port means comprising an inlet port means and an outlet port means disposed in fluid communication with a fluid source and an exhaust facility, said access port means being formed in said casing and disposed in fluid communication with said fluid passages by interconnecting conduit means.

17. The hydraulic motor as in claim 12 wherein said plurality of cylinders comprises ten such cylinders, said pistons being movable in free floating relation in each of said cylinders, said cylinders being disposed in radially surrounding relation to said valve means, wherein two adjacently disposed pistons on diametrically opposite sides of said shaft are under fluid pressure and define power strokes, whereby said motor is in balance relative to the drive forces applied to said drive means during operation of said motor.

18. The hydraulic motor as in claim 12 wherein said cam means comprises at least two cam elements having a substantially angular configuration, said cam elements located in spaced apart relation to one another and disposed on substantially opposite sides of said cylinder housing, said cam follower means extending laterally outwardly from opposed sides of said respective pistons and said cylinder housing in which said pistons are mounted, said cam follower means being positioned in movable engagement with said cam elements.

19. The hydraulic motor as in claim 18 wherein said cam follower means comprises oppositely disposed roller elements movably connected to each of said pistons in axially aligned relation to one another and mounted on the exterior of the cylinder housing and in movable engagement with the respective cam element.

20. The hydraulic motor as in claim 12 wherein each of said plurality of cylinders includes a first and second cylinder port formed in a base wall of each of said cylinders and disposed in fluid communication with said valve means, whereby fluid enters and exits each of said cylinders dependent upon the relative disposition between each of said cylinders and said valve means.

21. The hydraulic motor as in claim 20 wherein said valve means includes a cylindrical member disposed in surrounding relation to said shaft and disposed in surrounded disposition relative to said cylinder housing, said valve means including a first set of valve ports disposed in linearly spaced relation to one another and located in fluid communication with said first cylinder port of each cylinder in said cylinder housing, a second set of valve ports disposed in linearly spaced relation to one another and located in fluid communication with said second cylinder port of each cylinder in said cylinder housing.

* * * * *